United States Patent [19]

Theurer et al.

[11] 4,094,249

[45] June 13, 1978

[54] APPARATUS FOR LAYING TRACK

[75] Inventors: Josef Theurer, Vienna; Manfred Brunninger, Linz, both of Austria

[73] Assignee: Franz Plasser Bahnbaumaschinen-Industriegesellschaft m.b.H., Vienna, Austria

[21] Appl. No.: 749,885

[22] Filed: Dec. 13, 1976

[30] Foreign Application Priority Data

Feb. 2, 1976 Austria ..... 723/76

[51] Int. Cl.[2] ..... E01B 27/11; E01B 29/06

[52] U.S. Cl. ..... 104/6; 37/104; 104/2; 171/16

[58] Field of Search ..... 104/2, 3, 5, 6, 7 R, 104/12; 171/16; 37/104, 105, 106, 107

[56] References Cited

U.S. PATENT DOCUMENTS

| | | | |
|---|---|---|---|
| 2,142,208 | 1/1939 | Prutzeller | 171/16 X |
| 3,612,184 | 10/1971 | Plasser et al. | 171/16 |
| 3,638,578 | 2/1972 | Helgemeir | 104/12 |
| 3,654,868 | 4/1972 | Plasser et al. | 104/2 |
| 3,699,894 | 10/1972 | Plasser et al. | 104/2 |
| 4,004,524 | 1/1977 | Scheuchzer et al. | 104/2 |
| 4,046,077 | 9/1977 | Theurer et al. | 104/2 |

FOREIGN PATENT DOCUMENTS

| | | | |
|---|---|---|---|
| 1,303,502 | 4/1962 | France | 104/3 |
| 805,075 | 11/1958 | United Kingdom | 104/3 |
| 970,010 | 9/1964 | United Kingdom | 37/104 |

*Primary Examiner*—Randolph A. Reese
*Attorney, Agent, or Firm*—Kurt Kelman

[57] ABSTRACT

A track laying car has a rear undercarriage for moving the car in a working direction on the track rails and track-laying bogie for selective engagement with the ballast bed for moving the car on the ballast bed in the absence of a track for the rear undercarriage. An endless scraper conveyor chain is vertically adjustably mounted on the car and includes a transverse stringer arranged for engagement with the ballast bed for planing the ballast bed and conveying excess ballast from the planed bed, the stringer being arranged in front of the bogie. A tie conveyor is mounted on the car to convey ties in a direction opposite to the working direction to the planed ballast bed behind the bogie and to lay the conveyed ties sequentially on the planed ballast bed, and a ballast conveyor moves in a path arranged to enable the ballast conveyor to receive the excess ballast and to convey it in a direction opposite to the working direction to the rear end of the car where the ties have been laid on the planed ballast bed.

4 Claims, 4 Drawing Figures

APPARATUS FOR LAYING TRACK

The present invention relates to improvements in an apparatus for continuously laying track or for replacing sections of track. By way of example, an apparatus of this general type has been disclosed in our copending patent application Ser. No. 702,031, filed July 2, 1976, now U.S. Pat. No. 4,046,077 and the entire disclosure thereof is incorporated herein by way of reference. The improvements herein disclosed and claimed are useful in this type of apparatus but their usefulness is not limited thereto.

German Pat. No. 1,017,638 describes an apparatus for replacing sections of track, which comprises a bridge-like carrier frame provided with lifting and transport means and a considerable number of track building transport cars arranged ahead of the carrier frame and constituting a mobile train unit therewith. With this mobile apparatus, each track section is lifted off the ballast bed and is conveyed to the forward cars for disassembly into its component parts. Simultaneously, a new track is built on these cars, the rails being assembled with the conveyed ties by means of fasteners. This rebuilt track section is transported above the lifted track section to be disassembled and is layed on a previously planed ballast bed section behind the rear undercarriage of the carrier frame. For this purpose, a ballast plow is mounted on the carrier frame ahead of the rear undercarriage and a retractable roller is mounted on the carrier frame for engagement with the ballast bed planed by the plow, extension of the roller into engagement with the ballast bed lifting the rear undercarriage out of its support position. Such a track renewal apparatus requires not only a large number of track building transport cars but also means for disassembling the old track sections and assembling the new track sections. Any interruption in the assembly and/or disassembly at any point reduces the speed of operation. Therefore, track renewal with such an apparatus is slow and, therefore, interferes with regular train traffic for long periods of time. Furthermore, rollers move only very slowly even on planed ballast beds and make a stable support for the entire train difficult because the slow movement of the roller from point to point often causes uneven depressions in the ballast bed. In addition, the excess ballast plowed during planing of the ballast bed is simply moved to the sides where it is lost and sometimes even in the way.

U.S. Pat. No. 3,699,894 discloses an apparatus for the continuous replacement of an old track by a new track. In this mobile apparatus, the old track is removed in one direction and the new track or its components is conveyed in the other direction and laid in an intermediate trackless section wherein there are arranged ballast planing devices and ballast scraper conveyor chains for the removal of excess ballast. The entire train assembly is rather long and such track renewal trains have been used for major operations in which they have performed very effectively. The carrier frame for the ballast working mechanisms in the intermediate trackless section is mounted on two track-laying bogies, one of the bogies running on the previously planed ballast bed while the other bogie runs on the uneven bed from which the old track has been removed. This causes the carrier frame to move rather roughly and sometimes in spurts, which has an unfavorable influence on the accuracy of the track laying operation. Also, certain operating conditions, such as the location of railway stations, sometimes make it necessary to convey the old and the new track, and their components, only in a single direction. For these and various other reasons of economy, these large track renewal trains cannot be used for all types of track laying operations.

It is the primary object of this invention to improve and simplify track renewal with a relatively modest track laying apparatus.

This and other objects are accomplished in accordance with the invention with an apparatus which comprises the combination of an elongated bridge-like carrier frame, a rear undercarriage for moving the carrier frame in a working direction on the track rails, the undercarriage supporting the carrier frame adjacent the rear end thereof, and another undercarriage supporting the carrier frame adjacent the rear undercarriage and retractably arranged on the carrier frame for selective engagement with the ballast bed for moving the carrier frame in the working direction on the ballast bed in the absence of a track for the rear undercarriage. An endless scraper conveyor chain is vertically adjustably mounted on the carrier frame includes a transversely extending stringer arranged for engagement with the ballast bed upon vertical adjustment of the conveyor chain for planing the ballast bed and conveying excess ballast from the planed ballast bed. The stringer is arranged in front of the other undercarriage. Conveyor means mounted on the carrier frame is arranged to convey ties in a direction opposite to the working direction to the planed ballast bed behind the other undercarriage and to lay the conveyed ties sequentially on the planed ballast bed, and a ballast conveyor moves in a path arranged to enable the ballast conveyor to receive the excess ballast and to convey the excess ballast in a direction opposite to the working direction to the rear end of the carrier frame where the ties have been laid on the planed ballast bed.

Throughout the specification and claims, such terms as "rear," "front" and the like always refer to the working direction of the apparatus as it moves along the right of way on which the track is laid.

An apparatus of the described type assures a particularly high accuracy of the planed ballast bed on which the track is laid since none of the undercarriages moves on the uneven bed. This also increases the operating speed considerably and avoids all types of disturbances interrupting the continuous flow of the track laying operation. This mobile apparatus assures a stable and fast movement along the right of way during the entire operation while providing a simple, relatively short structure relatively free of any breakdowns. It may be used universally, even for very short sections of track to be renewed. Furthermore, the distance between the points where the ballast bed is planed and where the ties are laid is relatively short, and excess ballast is conveyed from the planed ballast bed directly to the rear end of the apparatus. When the scraper conveyor chain is vertically adjusted downwardly so that the planed ballast bed is lower than the original bed, the additional excess ballast can be handled readily without reducing the speed of operations.

The above and other objects, advantages and features of the present invention will become more apparent from the following detailed description of a now preferred embodiment thereof, taken in conjunction with the accompanying drawing wherein FIG. 1 is a side elevational view of the rear end of a track-laying apparatus according to this invention;

Figures 1, 2, 3, 4:
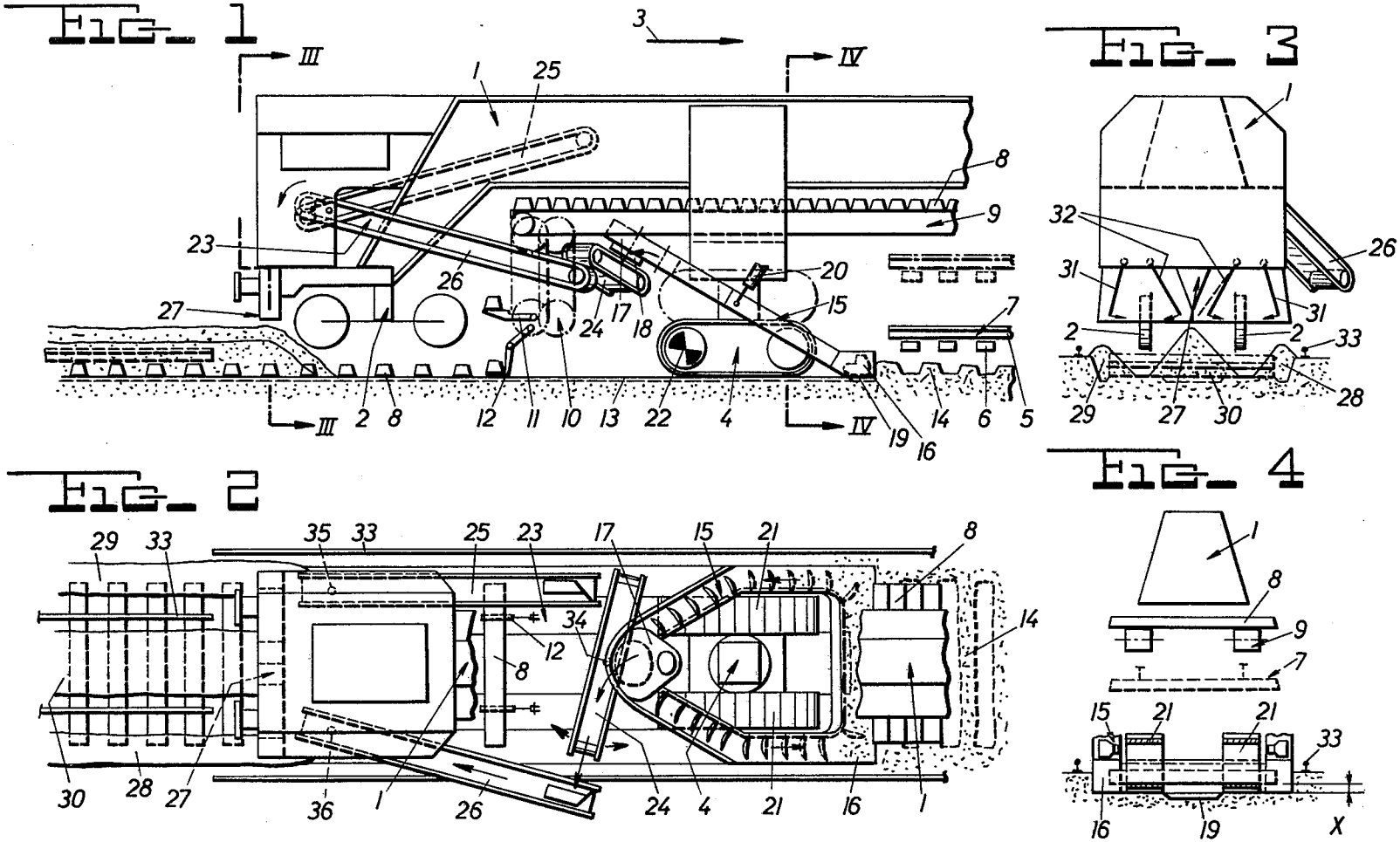
FIG. 2 is a top view of FIG. 1, portions of the carrier frame being removed to afford a better view of essential structures.
FIG. 3 is a section along line III—III of FIG. 1, showing the rear end of the apparatus partly in an end view.
FIG. 4 is a section along line IV—IV of FIG. 1.

Referring now to the drawing, which for purposes of illustration shows the rear portion of a track renewal apparatus of the type more fully described and illustrated in copending application Ser. No. 702,031, now U.S. Pat. No. 4,046,077 there is shown bridge-like carrier frame 1 supported at its rear end by rail-bound rear undercarriage 2 while its front end (not shown), in the working direction indicated by arrow 3, is also supported on a rail-bound undercarriage (not shown) which runs on the old track. Another undercarriage, which is not bound to a track and is illustrated as track-laying bogie 4, supports carrier frame 1 adjacent rear undercarriage 2. Bogie 4 is retractably arranged on the carrier frame for selective engagement with the ballast bed for moving the carrier frame in the working direction on the ballast bed in the absence of a track for the rear undercarriage, i.e. in the trackless intermediate section where the new track is to be laid. Since the improvements provided by the present invention are limited to the arrangement of the ballast planing mechanism in relation to the ballast conveyor and the undercarriage which is not bound to the track, only the rear portion of the apparatus has been illustrated and will be described herein.

As can be seen in FIG. 1, when retractable track-laying bogie 4 is extended into engagement with the ballast bed, track-bound rear undercarriage 2 is lifted off the track to enable the new track to be laid. When bogie 4 is retracted, carrier frame 1 will be supported at its rear end by undercarriage 2 on the laid track.

Old track section 7 comprised of old rails 5 and old ties 6 is lifted off the ballast bed and transported forwardly along carrier frame 1 by hoisting and transport means of any suitable type, such as described and illustrated in our copending application but not shown herein since they form no part of the invention.

Similarly, endless conveyor means 9 is mounted on the carrier frame and arranged in a known manner to convey ties 8 in a direction opposite to the working direction to the planed ballast bed behind the other undercarriage 4 and to lay conveyed ties 8 sequentially on the planed ballast bed. The conveyor path for new ties 8 extends above the path along which old track sections 7 are removed and the tie conveyor means comprises mechanism 10 consisting of an elevator chain with tie-supporting ledges lowering the ties 8 to the ballast bed and including a pivotal portion enabling the successive ties to be spacedly laid on the planed bed between bogie 4 and rear undercarriage 2. Tie lowering and laying means in track renewal trains are well known and illustrated mechanism 10 includes an endless vertical conveyor having tie-supporting plates 11 extending therefrom for receiving ties 8 from endless conveyor band 9 and dropping them on the planed ballast bed 13.

Endless scraper conveyor chain 15 is vertically adjustably mounted on the carrier frame for planing old ballast bed 14 to produce new ballast bed 13, which is usually at a somewhat lower level than the old ballast bed. The endless conveyor chain defines a polygonal conveying path, usually triangular or, as shown, pentagonal, including transversely extending stringer 16 arranged for engagement with the ballast bed upon vertical adjustment of the conveyor chain for planing the ballast bed and conveying excess ballast from the planed bed. The conveyor chain stringer is arranged in front of track-laying bogie 4. In the illustrated embodiment, scraper chain stringer 16 has a width substantially the same as that of bogie 4, as best seen in FIG. 4. Also, the endless conveyor chain and bogie 4 are combined into a structural unit, endless scraper conveyor chain 15 being mounted on the bogie and vertically adjustable thereon by means of hydraulic jack 20. This provides a particularly stable construction, the two track-laying treads 21 of bogie 4 serving to smooth the ballast bed planed by scraper chain stringer 16 and thus providing a very accurate support for the new rails to be laid. This effect will be further enhanced by imparting a vibration to bogie 4, vibratory drive 22 being built into the bogie.

A drive 17 entrains endless scraper conveyor chain 15 in a ballast conveying direction to deliver the excess ballast from planed ballast bed 13 to hopper 18 atop of the chain and the portion of the chain guide guiding stringer 16 has a downwardly projecting skirt 19 which smoothes a center strip of the planed ballast bed at a level slightly below that of the two strips produced by treads 21.

A ballast conveyor is arranged in a conveying path 23 to enable the ballast conveyor to receive the excess ballast from hopper 18 and to convey it in a direction opposite to the working direction indicated by arrow 3 to the rear end of carrier frame 1 where ties 8 have been laid on planed ballast bed 13. This ballast conveyor comprises substantially transversely extending endless conveyor band 24 and two longitudinally extending endless conveyor bands 25 and 26. As shown, ballast conveyor portion 24 defines a path intersecting the path of tie conveyor means 9 in the region of tie-laying mechanism 10, i.e. between bogie 4 and rear undercarriage 2. This arrangement produces a very space-saving construction and considerably shortens the overall length of the apparatus. It also assures a simple structural arrangement of the two conveyors so that they may operate without mutual interference for conveying the ties and the ballast.

Transverse ballast conveyor band 24 is arranged below hopper 18 for receiving the excess ballast therefrom and is mounted for pivoting about central pivot 34. The endless conveyor band is selectively drivable in opposite directions so as to feed the conveyed ballast either to longitudinal endless conveyor band 25 or 26, one of the ends of conveyor bands 25 and 26 being arranged adjacent respective ends of transverse conveyor band 24. The other ends of conveyor bands 25 and 26 are pivotally mounted at 35 and 36, respectively, at the rear end of carrier frame 1 whereby a selected one of the longitudinally extending endless conveyor bands 25 and 26 may be pivoted with the one end thereof arranged to receive the excess ballast from transversely extending conveyor band 24. The latter conveyor band is driven in the in the direction towards the selected longitudinally extending conveyor band.

With such a ballast conveyor arrangement, it is possible to deliver excess ballast selectively to either side 28 or 29 of the ballast bed, the pivoting of the longitudinally extending conveyor bands making it further possible to take into account various track conditions and widths.

At the rear end of carrier frame 1 and adjacent the pivoted ends of conveyor bands 25 and 26, there is arranged ballast distributor 27 to receive the excess ballast from these conveyor bands and distribute it to selected portions of the planed ballast bed on which ties 8 have been laid. A plurality of ballast distributing baffles 31, 32 are mounted on distributor 27 for guiding the ballast to sides 28 or 29, or to central strip 30 of the ballast bed, depending on the position of the baffles which are pivotal into selected guide positions. More particularly, the baffles are so adjusted that no ballast is delivered to the two strips on which new rails 33 are to be laid on ties 8. Such a ballast distributor further enhances the variability of the delivery of excess ballast to selected regions of the planed ballast bed, enabling such ballast to be deposited on one side, on both sides and/or on the central portion of the ballast bed, as desired. Thus, the cribs between the newly laid ties may be suitably filled with ballast according to local requirements while the strips receiving the new rails may remain free of such ballast.

The operation of the apparatus will be partly apparent from the above description of its structure and will now be further described in detail:

Carrier frame 1 rests with its front end (not shown) on a front undercarriage running on the old track to be replaced and with its rear end on extended track-laying bogie 4 running on planed ballast bed 13. Old track section 7, which extends between the front undercarriage and bogie 4, is removed from the track, hoisted up on carrier frame 1 and conveyed away in the direction of arrow 3, all in a manner fully described and shown in our copending patent application. Ties 8, which may be derived from the removed, old track sections after they have been disassembled or which may be new ties, are conveyed by endless conveyor band 9 in a direction opposite to the working direction in which the apparatus moves and are laid by mechanism 10 spacedly on planed ballast bed 13. Simultaneously, old ballast bed 14 is planed by scraper conveyor chain stringer 16 ahead of the region in which ties 8 are laid, the conveyor chain removes excess ballast, the two bogie treads 21 smooth and compact the two planed ballast bed strips which later support new rails 33 while skirt 19 forms depressed central portion 30 of the planed ballast bed.

The excess ballast is delivered to hopper 18 which discharges it on transverse conveyor band 24. Depending on the direction of movement of this conveyor band, the excess ballast is then conveyed to one of longitudinal conveyor bands 25 or 26 (26 in the illustrated position), suitable baffles being provided to guide the ballast from conveyor band 24 to the adjacent conveyor band. The longitudinal conveyor band conveys the ballast to distributor 27 whose baffles 31 and 32 may be so adjusted, as shown in FIG. 3, that the excess ballast is uniformly distributed over central ballast bed portion 30 and sides 28 and 29 of the ballast bed, particularly in the cribs between newly laid ties 8. Narrow strips between the sides of the bed and the center portion thereof will remain free of ballast to enable new rails 33 to be laid on ties 8.

The longitudinal conveyor band selected for operation depends on the local track conditions and the conveyor band not in use (band 25 in the illustrated position) will be pivoted upwardly into an inoperative position. This arrangement makes it possible to produce an accurately planed new bed which may be, if desired, lower than the old bed by a selected distance $x$ and to use the excess ballast obtained by the planing of the bed to build up the ballast bed of the new track.

Various modifications are possible in the scraper conveyor chain structure and the ballast conveyor, as well as in the tie conveyor arrangement. The scope of the invention is defined by the appended claims.

What is claimed is:

1. An apparatus for laying track comprised of rails and ties on a ballast bed, comprising the combination of (a) an elongated bridge-like carrier frame having a rear end, (b) a rear undercarriage for moving the carrier frame in a working direction on the track rails, the undercarriage supporting the carrier frame adjacent the rear end thereof, (c) another undercarriage supporting the carrier frame adjacent the rear undercarriage and retractably arranged on the carrier frame for selective engagement with the ballast bed for moving the carrier frame in the working direction on the ballast bed in the absence of a track for the rear undercarriage, (d) an endless scraper conveyor chain vertically adjustably mounted on the carrier frame and including a transversely extending stringer arranged for engagement with the ballast bed upon vertical adjustment of the conveyor chain for planing the ballast bed and conveying excess ballast from the planed ballast bed, the stringer of the conveyor chain being arranged in front of the other undercarriage, (e) conveyor means mounted on the carrier frame and arranged to convey ties in a direction opposite to the working direction to the planed ballast bed behind the other undercarriage and comprising a mechanism for laying successive ones of the conveyed ties spacedly on the planed ballast bed between the other undercarriage and the rear undercarriage, and (f) a ballast conveyor moving in a path arranged to enable the ballast conveyor to receive the excess ballast and to convey the excess ballast in a direction opposite to the working direction to the rear end of the carrier frame where the ties have been laid on the planed ballast bed, a transversely extending portion of the path of the ballast conveyor intersecting the path of the conveyor means in the region of the mechanism.

2. The track laying apparatus of claim 1, wherein the other undercarriage is a track-laying bogie and the endless scraper conveyor chain and the track-laying bogie are combined into a structural unit.

3. The track laying apparatus of claim 1, further comprising a hopper receiving the conveyed excess ballast from the endless scraper conveyor chain, and the ballast conveyor comprising a substantially transversely extending endless conveyor band arranged below the hopper for receiving the excess ballast therefrom, the transversely extending endless conveyor band being mounted for pivoting about a central pivot and being selectively drivable in opposite directions, and two longitudinally extending endless conveyor bands each having two ends, one of the ends of the longitudinally extending endless conveyor bands being arranged adjacent respective ends of the transversely extending endless conveyor band and the other ends of the longitudinally extending endless conveyor bands being pivotally mounted at the rear end of the carrier frame whereby a selected one of the longitudinally extending endless conveyor bands may be pivoted with the one end thereof arranged to receive the excess ballast from the transversely extending conveyor band, the latter conveyor band being driven in the direction towards the selected longitudinally extending conveyor band.

4. The track laying apparatus of claim 1, wherein the other undercarriage is a track-laying bogie having two treads spaced apart a distance corresponding substantially to the gauge of the track and comprising a means for vibrating the track-laying bogie.

* * * * *